United States Patent [19]

Hameister

[11] Patent Number: 4,457,484

[45] Date of Patent: Jul. 3, 1984

[54] DISPLAY MOUNTING ASSEMBLY FOR COLLECTOR PLATES

[76] Inventor: Helen M. Hameister, 40638 Colony Dr., Sterling Hts., Mich. 48078

[21] Appl. No.: 334,711

[22] Filed: Dec. 28, 1981

[51] Int. Cl.[3] ..... A47G 1/16

[52] U.S. Cl. ..... 248/490; D6/418; D6/450; D8/355; D8/373; 248/316.4

[58] Field of Search ..... 248/490, 172, 316.6, 248/442, 488, 491, 231.4, 297.2, 297.3, 477, 496, 670; 211/41; D6/142; D8/355, 373

[56] References Cited

U.S. PATENT DOCUMENTS

| | | | |
|---|---|---|---|
| 266,356 | 10/1882 | Eshbaugh | 248/489 |
| 625,271 | 5/1899 | Lang | 248/297.2 X |
| 1,705,582 | 3/1929 | May | 248/316.3 |
| 2,300,972 | 11/1942 | Robinson | 248/491 |
| 2,315,268 | 3/1943 | Oliphant | 248/490 |
| 2,488,147 | 11/1949 | Theisen | 211/41 X |
| 2,508,841 | 5/1950 | Schreibman | 211/41 |
| 2,695,473 | 11/1954 | Lynch | 248/491 X |
| 2,826,384 | 3/1958 | Brown | 248/491 |
| 2,880,951 | 4/1959 | Springer | 248/172 X |
| 2,899,154 | 8/1959 | Zavolner | 248/491 |
| 3,330,524 | 7/1967 | Foley | 248/441 A |
| 3,349,443 | 10/1967 | Sury | 248/490 X |
| 3,740,016 | 6/1973 | Buescher | 248/488 |
| 4,106,742 | 8/1978 | Miller et al. | 248/488 |

*Primary Examiner*—J. Franklin Foss
*Assistant Examiner*—David L. Talbott
*Attorney, Agent, or Firm*—Cullen, Sloman, Cantor, Grauer, Scott & Rutherford

[57] ABSTRACT

The mounting assembly is for supporting a plate in an attitude suitable for display. The assembly includes a frame having a first generally flat and circular inner plate portion and a second integral curved outer rim portion around the outer periphery of the plate portion. Together the portions form a generally concave shaped cavity for receiving a plate on the inner surface thereof. A plurality of elongated slots are provided in and extend through the rim portion. Each slot extends from the outer edge of the rim portion towards the plate portion. A plurality of radially spaced apart protuberances are located on the outer surface of the rim portion along a longitudinal edge of each slot. An adjustable clip is slidable in each slot, with each clip including a cradle adapted to receive and to engage a peripheral edge portion of a plate when mounted thereon. Each clip has a generally flexible arm engageable with the outer surface of the rim portion and with one of the protuberances to be retained thereby in an adjusted position to hold the plate.

5 Claims, 7 Drawing Figures

DISPLAY MOUNTING ASSEMBLY FOR COLLECTOR PLATES

BACKGROUND OF THE INVENTION

1. Field of the Invention

This invention relates to a display mounting assembly which is primarily used by collectors of decorative plates.

2. Description of the Prior Art

It is frequently desirable to display decorative plates in the home. One common method of displaying a plate is to place it in a vertical attitude within a china cabinet, but such plates may also be mounted in a rack positioned on a desk or mounted on a wall. Frequently, the plates are not securely fastened to such a rack and may fall and be broken if accidently jarred. Also the plate itself is offered no protection by the rack in the event the rack and plate are both dropped or jarred.

In addition, conventional means of display offer no aesthetic compliment to the plate displayed and it has been common, when a more attractive means of display is desired, to position the plate between the glass and the backing of a custom-made picture frame. Although the picture frame will aesthetically compliment the plate, it must be manufactured to specification so that it will properly receive and secure a particular plate placed therein. As such, expensive means of manufacture must be employed to obtain a suitable frame for the display of a particular plate.

There are also many prior art holders for mounting decorative plates including wire frames; however, such prior art devices have not been commercially acceptable for various reasons including the fact that such constructions were complicated, inefficient, expensive and difficult to assemble and to maintain. The prior art includes the disclosures of the following United States patents:

| U.S. Pat. No. | Inventor | Title |
|---|---|---|
| 266,356 | Eshbaugh | Picture Hanging Device |
| 2,300,972 | Robinson | Plate Holder |
| 2,315,268 | Oliphant | Plate Hanger |
| 2,488,147 | Theisen | Plate Holder |
| 2,695,473 | Lynch | Plate Suspending Device |
| 2,826,384 | Brown | Plate Hangers |
| 2,899,154 | Zavolner | Adjustable Plate Holders And the Like |
| 3,349,443 | Sury | Fastener Clip For Mounting Pictures And the Like |
| 3,740,016 | Buescher | Decorative Plate Display Device |
| 4,106,742 | Miller | Decorative Plate Mounting Assembly |

SUMMARY OF THE PRESENT INVENTION

It is a feature of the present invention to provide a mounting assembly which includes means for displaying a decorative collector plate upon a wall or other support.

A further feature is to provide a mounting assembly for removably retaining and for displaying decorative plates.

A still further feature is to provide a mounting assembly by which the plate can be easily, readily and attractively displayed upon a wall or other support.

Another feature is to provide a frame assembly which will accommodate plates of various sizes, diameters and shapes.

Still another feature is to provide a frame or mounting assembly for a decorative plate in which the plate cannot be removed without removing the assembly from the wall or support structure.

A further feature is to provide a mounting assembly which includes a frame having a first generally flat and circular inner plate portion and a second integral curved outer rim portion around the outer periphery of the plate portion, which together form a generally concave or bowl shaped cavity for receiving a decorative plate. The mounting assembly includes a plurality of elongated slots in the rim portion, with each slot having an adjustable clip provided with a cradle which is adapted to engage the peripheral edge of the plate when located in the cavity. To locate the clips at one of a number of positions, corresponding to the outside diameter of the plate, there are provided along one edge of each slot, on the outer surface of the rim portion, a plurality of protuberances. Each clip includes a flexible arm engageable with the outer surface of the rim portion and with one of the protuberances to be retained thereby in an adjusted position to hold the plate.

A still further feature is to provide a mounting assembly of the aforementioned type wherein the inner plate portion is provided with one or more openings for receiving a fastening element for mounting the assembly on a support.

Another feature is to provide a mounting assembly as described which is provided with two pairs of elongated slots, with the slots being arranged perpendicular to the center axis of the plate portion. With such a construction, the slots in each pair are located 180° apart.

Still another feature is to provide a mounting assembly of the aforementioned type wherein each clip is made from a clear transparent plastic material so that the cradle which receives a peripheral edge portion of the plate generally is not easily viewable from the front.

Another feature is to provide a mounting assembly as described wherein the flexible arm is located at one edge or the opposite edge of the clip and is suitable for either left hand or right hand use depending on the location of the protuberances.

A further feature is to provide a mounting assembly as described wherein the clips are slidable on guide elements extending into the slots.

A final feature is to provide a mounting assembly which is simple in construction, sturdy, easy to assemble and to maintain and is made from a lightweight plastic material.

IN THE DRAWINGS

DESCRIPTION OF A PREFERRED EMBODIMENT

Figure 1:
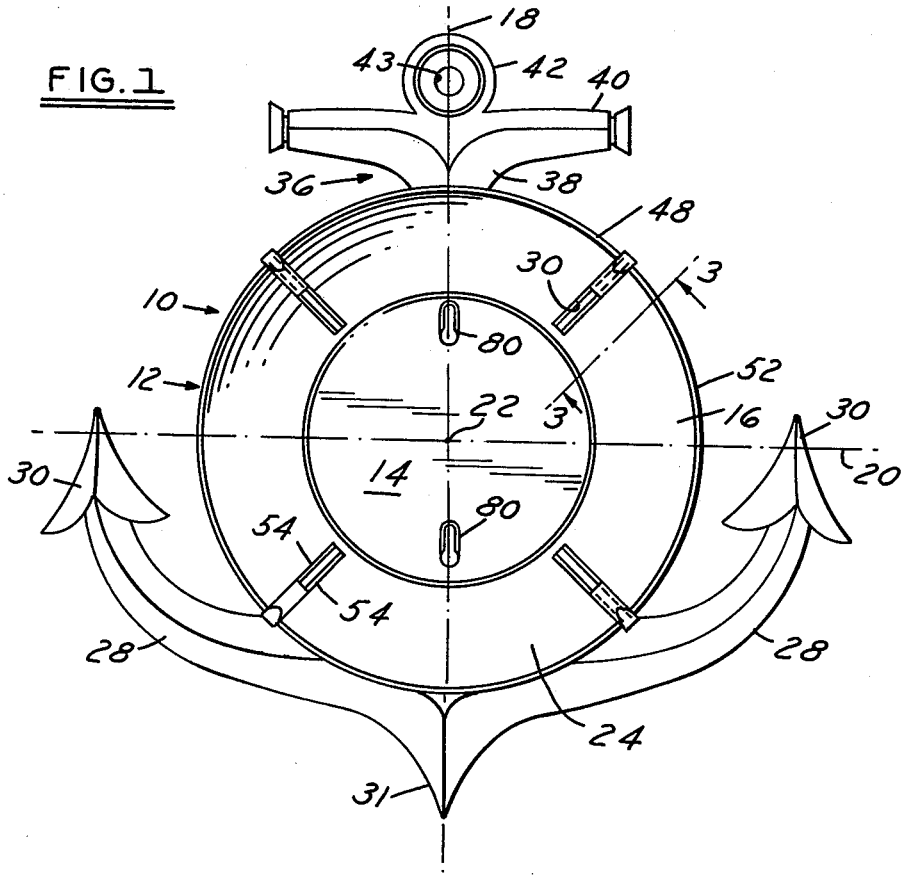
FIG. 1 is a front elevation of the mounting assembly.
Figure 2:
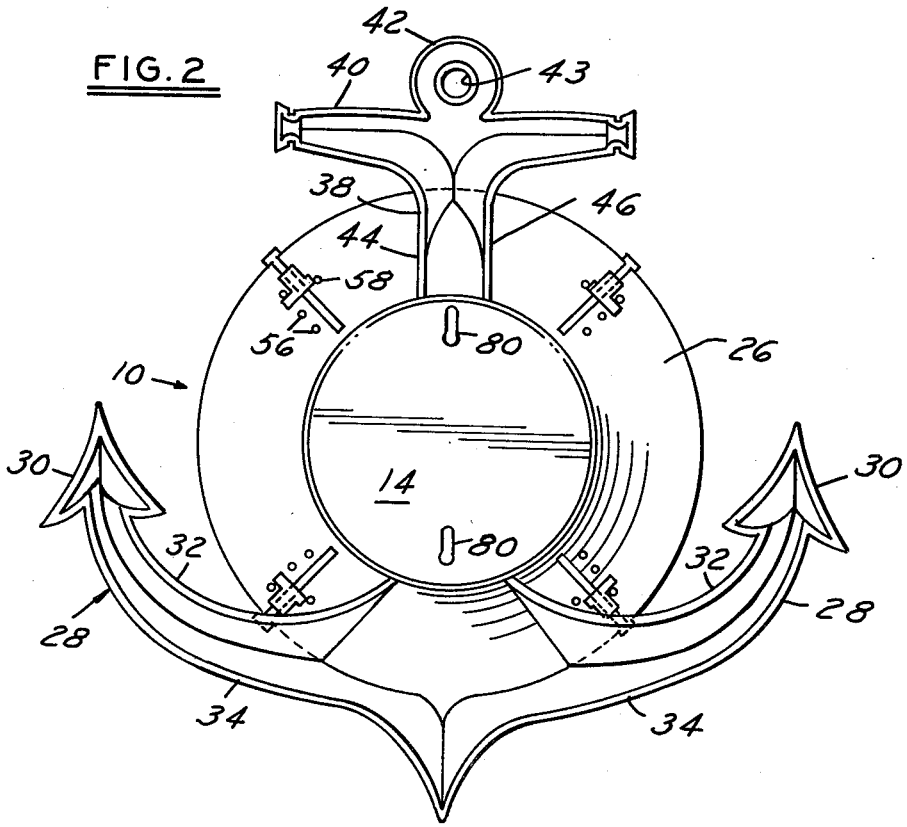
FIG. 2 is a back elevation of the mounting assembly.

The mounting assembly is designated in FIGS. 1 and 2 by the numeral 10. The assembly is used for supporting a decorative plate in an attitude suitable for display.

The assembly 10, as shown in FIG. 1, includes a generally circular shaped frame 12 having a first flat and circular inner plate portion 14 and a second integral curved outer rim portion 16 located around the outer periphery of the plate portion 14. The center plate portion 14 is flat. The mounting assembly 10 includes a vertical axis 18 and a horizontal axis 20 which intersect at the center of the plate portion 14 as indicated by the numeral 22.

Figure 3:
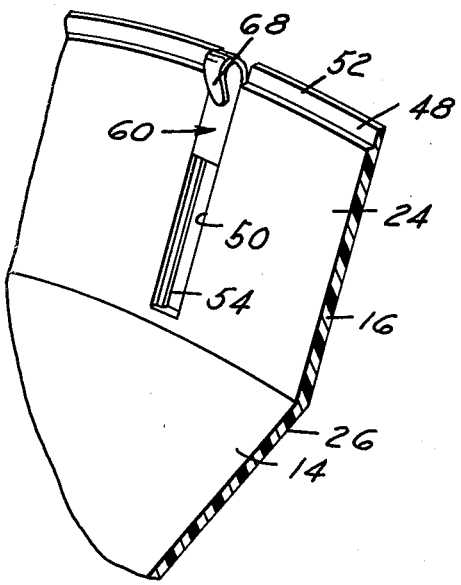
FIG. 3 is a fragmentary perspective view taken on the line 3—3 of FIG. 1 and showing the cradle provided on one of the clips.
Figure 4:
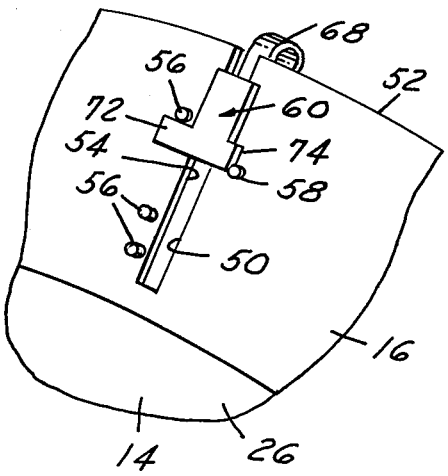
FIG. 4 is a fragmentary back view of the assembly, showing the rear side of a clip and the corresponding latching protuberance.

The plate portion 14 and rim portion 16, as shown in FIGS. 1 and 3, together form a generally concave or bowl shaped cavity in the inner surface 24 of the assembly. In addition, the mounting assembly 10 has a rear or back side outer surface 26 as shown in FIGS. 2 and 4.

The mounting assembly 10 has, in part, the appearance of an anchor and includes a pair of arms or flukes 28 which are provided with pointed barbs or arrowheads 30 pointing or tending upwardly. The arms 28 meet on the center axis 18 and form a downwardly extending point or fluke 31.

The arms 28 throughout their extent are of thin wall construction, formed integrally with the plate and rim portions 14 and 16. As shown by the back side of the assembly 10 in FIG. 2, the arms 28 have curved walls 32 and 34 which are spaced apart througout the major extent thereof, being connected only at the apex of arrow-heads 30 and fluke 31.

The top of the mounting assembly 10 is provided with a T-shaped integral molded bracket 36 formed with the rim portion 16. Bracket 36 includes a strut portion 38, a pair of arms 40 and a center ring 42 having an opening 43, all of which assist in providing the anchor appearance. The T-shaped bracket 36, as shown in FIG. 2, includes a pair of spaced apart wall sections 44 and 46 which form the strut portion 38, arms 40 and ring 42.

The appearance of the mounting assembly 10 is also enhanced by its antique gold coloring. The arms 28 and T-shaped bracket 36 are dimpled on the front surface and also have a rustic or antique gold coloring further enhancing the nautical and anchor theme of the entire mounting assembly.

The front surface 24 at the outer periphery thereof is provided with an annular rim or lip 48. A plurality of elongated slots 50 are provided in and extend through the lip 48 and rim portion 16. Each slot 50 extends from the outer edge 52 of the rim portion 16 towards the plate portion 14 and include at the longitudinal edges thereof a pair of longitudinally spaced guide elements 54. Each guide element 54 has a thickness corresponding to the thickness of the lip 48. The guide elements 54 extend to the bottom of the slot 50 as shown in FIGS. 1 and 3. The slots 50 are arranged in pairs, with the slots of each pair being located 180° apart.

The outer surface 26 of the rim portion 16 is provided with a plurality of radially spaced apart knobs or protuberances 56 as shown in FIGS. 2 and 4. As an example, three protuberances or knobs 54 are shown on one or the other longitudinal edge of the slot 50. The other longitudinal edge of each slot has a single knob or protuberance 58. One protuberane 56 of each slot 50 is located on a predetermined diameter measured from the center axis 22. This diameter corresponds to the diameter of the plate to be held in the cavity on the front surface 24 of the decorative plate and mounting assembly 10. Specifically it can accommodate plate sizes from 8.5 inches through 10.5 inches.

Figure 5:
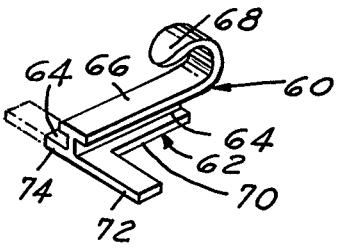
FIG. 5 is a perspective view of a clip.

Each slot 50 including the pair of elongated guide elements 54 guide and retain an adjustable, resilient and slidable clip 60, of the type shown in FIG. 5. Clip 60 is injection molded in one piece from a clear transparent plastic material such as Lexan. Clip 60 includes an elongated base 62 having opposed channels 64 in the longitudinal edges thereof. Thus the base 62 has an I-shaped cross-section as shown in FIG. 5. The top flange 66 of the base 62 located on the front side of the clip 60 has an integral cradle 68 in the form of a curved lip adapted to receive and to engage a peripheral edge portion of a plate when the clip 60 is assembled in a slot 50 of the mounting assembly 10.

The bottom flange 66 of the base 62 located on the rear side of the clip 60 is provided at one end or edge with an integral transversely extending flexible long arm 72 and with an integral short-flexible arm 74 as illustrated in FIGS. 4 and 5. Each slot 50 is provided with a clip 60. The longitudinally spaced guide elements 54 of each slot 50 are received in the opposed channels 64 of the corresponding base 62 whereby the clip 60 is guided in the slot to the proper setting or diameter by the guide elements 54.

The long arm 72 may be located as shown in FIG. 5 or on the opposite edge of the clip (in place of the short arm 74) to provide for either left hand or right hand use depending on the location of the protuberances 56 or 58. In FIG. 2 is should be noted that two right hand clips and two left hand clips are utilized, with the clips of each pair located 180° apart being either right handed or left handed.

The long arm 74 of each clip 60 engages the back side or surface 26 of the rim portion 16 and is assembled over one of the knobs or protuberances 56 or 58. In FIG. 4, the clip 60 is inserted in slot 50, with the flexible long arm 72 lifted or raised over the first knob 56 and thus may hold a plate having a diameter of 10.5 inches. The short arm 74 does not engage the single knob 58.

The right and left hand clips shown in FIGS. 1 and 2 may be reversed whereby the long arms 72 are lifted over the single knob 58 to accommodate a plate having a diameter of 10 inches. In such a case the short arms 74 will not engage the knobs 56.

When a smaller plate is to be mounted, such as one with a diameter, as an example, of 9.25 inches or 8.50 inches, the clips 60 are again reversed to accommodate the long arms 72 of clips 60 behind one or the other of the remaining knobs 56 forming the required diameter.

When a plate is mounted on the assembly 10, with the cradle 68 engaging the peripheral edge portion of the plate, such cradles are generally not easily viewable from the front because of the use of clear plastic material.

It should be noted that the I-shaped base 62 of clip 60 has side or flange 66 longer than flange 70 to provide for the curved end or cradle 68.

The circular inner plate portion 14 of assembly 10 is provided with a pair of key-hole slots 80 adapted to receive a pair of fasteners, not shown, for mounting same to a support.

Figure 7:
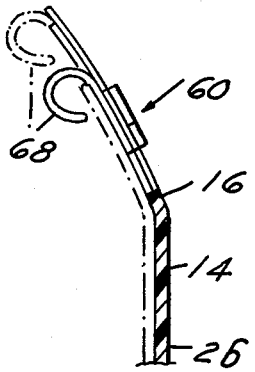
FIG. 7 is a fragmentary sectional view taken on the line 7—7 of FIG. 6.
Figure 6:
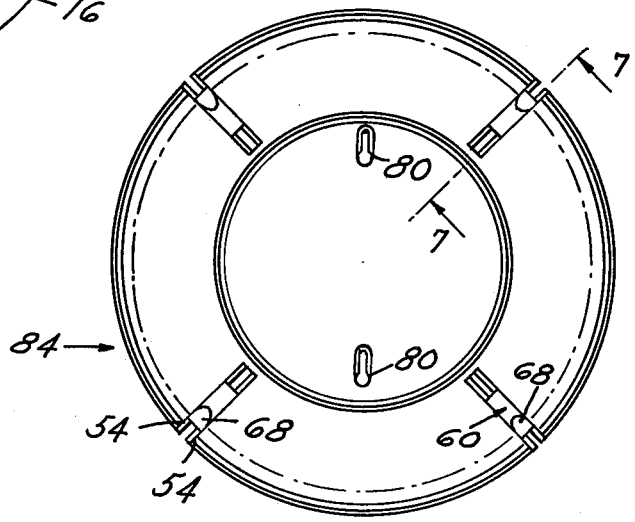
FIG. 6 is a front elevation of another embodiment of a mounting assembly.

The mounting assembly 84 of FIGS. 6 and 7 use generally the same components as the embodiment of FIGS. 1–5 inclusive except for the anchor components 28, 30, 36, 40 and 42. Therefore, the same numerals are used to designate similar parts.

It will be appreciated that the resilient clips 60 are easily removed from the slots 50 to permit the plate to be changed, cleaned or otherwise displayed.

I claim:

1. A mounting assembly for supporting a plate in an attitude suitable for display, and assembly comprising a frame having a first generally flat and circular inner plate portion with a center axis and a second integral curved outer rim portion around the outer periphery of said plate portion, said portions being generally bowl shaped for receiving a plate on the inner surface thereof, a plurality of elongated slots provided in and extending through said rim portion, each slot extending from the outer edge of said rim portion towards said plate portion, a plurality of radially spaced apart protuberances located on the outer surface of said rim portion along opposed longitudinal edges of each slot, an adjustable clip slidable in each slot, each clip including a cradle adapted to receive and to engage a peripheral edge portion of a plate when placed on said inner surface, each clip having a generally flexible arm engageable with the outer surface of said rim portion and with one of the protuberances to be retained thereby in an adjusted position, each clip includes an elongated base having opposed channels in the longitudinal edges thereof, each slot including a pair of longitudinally spaced guide elements which are received in the opposed channels of the corresponding clip whereby the clip is guided in the slot by said guide elements, and with one side of said clip base being longer than the other side and curved at one end to form said cradle, said flexible arm being connected to the other side of said base at one end thereof, and the longitudinal axis of said flexible arm being perpendicular to the longitudinal axis of said base, and wherein there are an equal number of protuberances along each slot, with each protuberance of each slot having corresponding protuberances in the remaining slots which are spaced the same distance from the outer edge of said rim portion.

2. The mounting assembly defined in claim 1 wherein said inner plate portion is provided with one or more openings for receiving a fastening element for mounting the assembly on a support.

3. The mounting assembly defined in claim 1 wherein two pairs of elongated slots are provided, said slots being arranged perpendicular to the center axis of said plate portion, the slots in each pair being located 180° apart.

4. The mounting assembly defined in claim 1 wherein each clip is made from a clear transparent plastic material so that the cradle which receives a peripheral edge portion of the plate generally is not easily viewable from the front.

5. The mounting assembly defined in claim 1 wherein said frame, at the upper and lower extremities thereof, is provided with integrally molded elements assimilating an anchor.

* * * * *